US009046288B2

(12) United States Patent
Cho

(10) Patent No.: US 9,046,288 B2
(45) Date of Patent: Jun. 2, 2015

(54) PUMPED TWO PHASE FLUID ROUTING SYSTEM AND METHOD OF ROUTING A WORKING FLUID FOR TRANSFERRING HEAT

(71) Applicant: Wei-Lin Cho, Unionville, CT (US)

(72) Inventor: Wei-Lin Cho, Unionville, CT (US)

(73) Assignee: HAMILTON SUNDSTRAND SPACE SYSTEMS INTERNATIONAL, INC., Windsor Locks, CT (US)

( * ) Notice: Subject to any disclaimer, the term of this patent is extended or adjusted under 35 U.S.C. 154(b) by 240 days.

(21) Appl. No.: 13/683,082

(22) Filed: Nov. 21, 2012

(65) Prior Publication Data

US 2014/0137581 A1 May 22, 2014

(51) Int. Cl.
*F25D 17/02* (2006.01)
*F25B 39/02* (2006.01)
*F25B 23/00* (2006.01)

(52) U.S. Cl.
CPC ..... *F25B 39/028* (2013.01); *F25B 23/006* (2013.01)

(58) Field of Classification Search
CPC ..... F25B 39/028; F25B 39/04; F25B 40/02; F25B 41/00; F25B 43/00; F25B 2309/002
USPC ..... 62/118, 119, 527, 528, 513
See application file for complete search history.

(56) References Cited

U.S. PATENT DOCUMENTS 4,560,533 A * 12/1985 Huebotter et al. ..... 376/367
4,685,512 A * 8/1987 Edelstein et al. ..... 165/104.14
4,862,708 A * 9/1989 Basiulis ..... 62/502
5,103,897 A * 4/1992 Cullimore et al. ..... 165/274
5,587,880 A * 12/1996 Phillips et al. ..... 361/679.47
5,932,148 A * 8/1999 Hansell et al. ..... 261/106
6,990,816 B1 * 1/2006 Zuo et al. ..... 62/3.7
7,543,629 B2 * 6/2009 Chin et al. ..... 165/104.21
2002/0050341 A1 * 5/2002 Dussinger et al. ..... 165/104.26
2004/0050533 A1 * 3/2004 Chesser et al. ..... 165/46
2005/0082158 A1 * 4/2005 Wenger ..... 202/155
2006/0254753 A1 * 11/2006 Phillips et al. ..... 165/100
2007/0187072 A1 * 8/2007 Chin et al. ..... 165/104.26
2008/0124722 A1 * 5/2008 Dromaretsky et al. ..... 435/6
2008/0283223 A1 * 11/2008 Chang et al. ..... 165/104.26
2010/0071880 A1 * 3/2010 Kim et al. ..... 165/104.26
2010/0188818 A1 * 7/2010 Li ..... 361/700
2011/0088875 A1 * 4/2011 Hou ..... 165/104.26
2011/0277967 A1 * 11/2011 Fried et al. ..... 165/104.26
2011/0292601 A1 * 12/2011 Campbell et al. ..... 361/691
2012/0131932 A1 * 5/2012 Kroliczek et al. ..... 62/6

* cited by examiner

*Primary Examiner* — Mohammad M Ali
(74) *Attorney, Agent, or Firm* — Cantor Colburn LLP

(57) ABSTRACT

A pumped two phase fluid routing system includes an evaporator. The evaporator includes a base portion having an input liquid port for receiving a working fluid and an output liquid port for expelling a liquid. The evaporator also includes a wick portion including a plurality of vapor grooves and a plurality of vapor vents for providing a vapor flow path of a vapor formed within the evaporator. The evaporator further includes a lid portion disposed in close proximity to the wick portion and receiving heat for formation of the vapor, the lid portion having a vapor port for expelling the vapor. The fluid routing system also includes a first liquid line in fluid communication with the base portion for receiving the expelled liquid. The fluid routing system further includes a vapor line in fluid communication with the lid portion for receiving the expelled vapor.

13 Claims, 7 Drawing Sheets

PUMPED TWO PHASE FLUID ROUTING SYSTEM AND METHOD OF ROUTING A WORKING FLUID FOR TRANSFERRING HEAT

BACKGROUND OF THE INVENTION

The present invention relates to heat transfer cycles, and more particularly to a routing system for such cycles, as well as a method of routing a working fluid for the cycles.

A wide variety of approaches have been employed to transport heat, such as throughout a fluid routing system containing one or more heat exchanging devices. These approaches may be categorized as passive or active. An active system consumes power to move heat, and may include pumping a single phase liquid throughout a loop or circuit, for example. The vapor compression cycle approach requires the use of a compressor to compress the working fluid from vapor phase to liquid phase. A condenser downstream of the compressor rejects the sensible heat from compressed liquid. The evaporator at the final stage of the cycle allows the high pressure liquid to vaporize and absorb the heat from the heat source. Such systems typically consume a large amount of power and a large amount of working fluid is required. A passive system does not consume power and may rely on devices such as a heat pipe or loop heat pipe, for example. This type of system "pumps" the working fluid by capillary pressure produced by a porous wick structure inside the evaporator. Although power consumption is avoided, the capillary pressure produced by the evaporator wick is limited, which thereby decreases system efficiency and heat transport capability.

BRIEF DESCRIPTION OF THE INVENTION

According to one embodiment, a pumped two phase fluid routing system includes an evaporator. The evaporator includes a base portion having an input liquid port for receiving a working fluid and an output liquid port for expelling a liquid. The evaporator also includes a wick portion including a plurality of vapor grooves and a plurality of vapor vents for providing a vapor flow path of a vapor formed within the evaporator. The evaporator further includes a lid portion disposed in close proximity to the wick portion and receiving heat for formation of the vapor, the lid portion having a vapor port for expelling the vapor. The pumped two phase fluid routing system also includes a first liquid line in fluid communication with the base portion for receiving the expelled liquid. The fluid routing system further includes a vapor line in fluid communication with the lid portion for receiving the expelled vapor.

According to another embodiment, a method of routing a working fluid for transferring heat is provided. The method includes providing a working fluid to an evaporator. Also included is heating the working fluid to form a vapor and a liquid, wherein the vapor is expelled from the evaporator to a vapor line and the liquid is expelled from the evaporator to a first liquid line. Further included is condensing the vapor to form a condensate fluid for routing through a second liquid line. Yet further included is combining the liquid and the condensate fluid to form the working fluid for storage in a reservoir.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
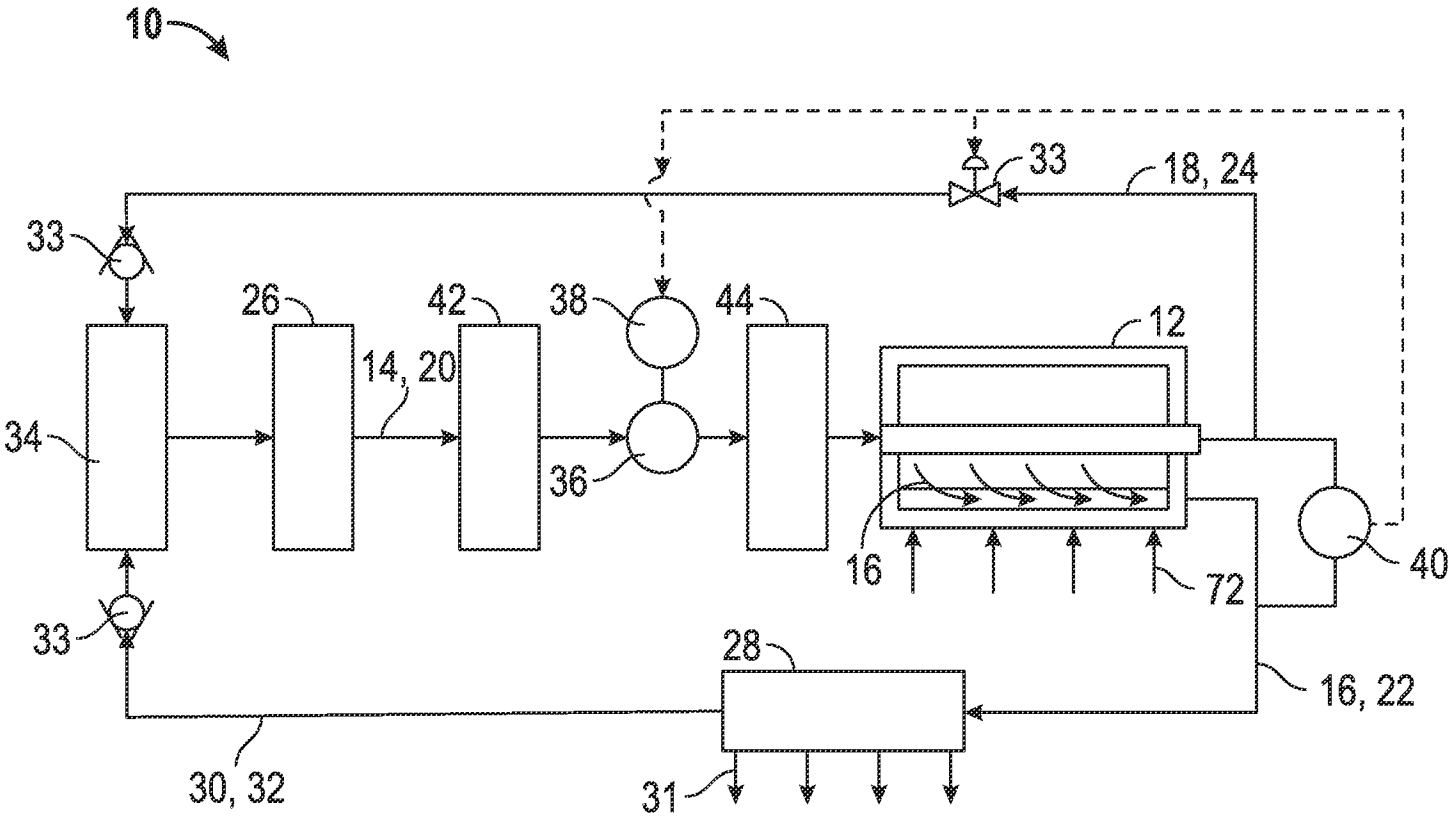
FIG. 1 is a schematic illustration of a pumped two phase fluid routing system according to a first embodiment.

Referring to FIG. 1, a fluid routing system 10 according to a first embodiment is schematically illustrated. The fluid routing system 10 may be used in conjunction with a wide variety of applications, including in vehicle systems, for example. Generally, any system or application requiring transportation of heat may benefit from the fluid routing system 10.

The fluid routing system 10 includes an evaporator 12, which may be characterized as a two phase evaporator based on the conversion of a working fluid 14 to two phases of the fluid. Specifically, the working fluid 14 is expelled from the evaporator 12 as a vapor 16 and a liquid 18. The structure and function of the evaporator 12 will be described in greater detail below. The working fluid 14 is received from a main feed line 20 in operable communication with the evaporator 12. Subsequently, the vapor 16 is expelled to a vapor line 22 coupled to the evaporator 12, while the liquid 18 is expelled to a first liquid line 24 that is also coupled to the evaporator 12. The liquid 18 sent to the first liquid line 24 is a surplus fluid that is not vaporized in the evaporator 12 and is returned to a reservoir 26 for collection and storage therein. The return of the liquid 18 to the reservoir 26 provides a cycle for reuse of the liquid 18 within the fluid routing system 10.

The vapor 16 is also returned to the reservoir 26, but is first directed through a condenser 28 to form a condensate fluid 30 with a release of a heat output 31. The condenser 28 is in operable communication with the vapor line 22 and a second liquid line 32. It is to be appreciated that each of the vapor line 22, the first liquid line 24 and the second liquid line 32 may include one or more valves 33 to assist in controlling the flow of the respective fluids being routed through the lines. After condensation of the vapor 16 in the condenser 28, the condensate fluid 30 is routed to the second liquid line 32 and therethrough to the reservoir 26 for combination with the liquid 18 to form the working fluid 14 that will be recycled to the evaporator 12. As illustrated, a phase separator 34 may be included to ensure that the working fluid 14 supplied to the reservoir 26 is a substantially homogeneous, single phase liquid. This is beneficial for separation of the condensate fluid 30, which may be of a two phase liquid and vapor upon expulsion from the condenser 28. The phase separator 34 routes the working fluid 14 through the main feed line 20 to the reservoir 26.

A pump 36 is disposed along the main feed line 20 to facilitate pumping of the working fluid 14 to the evaporator 12 when the working fluid 14 is required. In the exemplary embodiment, the pump 36 is powered by a motor 38 that is in communication with a controller 40. The controller 40 is in operable communication with numerous components within the fluid routing system 10, such as the evaporator 12, the vapor line 22, the first liquid line 24, and the motor 38, for example. Additionally, the controller 40 may be in communication with at least one of the one or more valves 33 to further enhance control over the flow within the lines. The controller 40 is configured to monitor operation of the evaporator 12 and may receive information relating to pressure within the vapor line 22 and the first liquid line 24. Such information leads to a determination of a desired flow rate of the working fluid 14 to be generated by the pump 36.

A first cooling device 42 is disposed upstream of the pump 36 to cool the working fluid 14 to a suitable level for operation within the evaporator 12. Cooling of the working fluid 14 upstream of the pump 36 reduces the likelihood that the working fluid 14 contains cavitation therein. The term "cavitation" refers to a system pressure that is less than the working fluid vapor pressure. Such a condition leads to inefficient flow of the working fluid 14. Cavitation is further avoided by implementation of the phase separator 34, which separates the vapor 16 from the working fluid 14 combined in the phase separator 34. Based on the upstream location of the first cooling device 42, subsequent routing through the pump 36 results in heating of the working fluid 14 due to heat leak from the pump 36. To account for the heating of the working fluid 14, a second cooling device 44 is disposed downstream of the pump 36 at a location just prior to delivery of the working fluid 14 to the evaporator 12, which completes the cycle.

Figure 2:
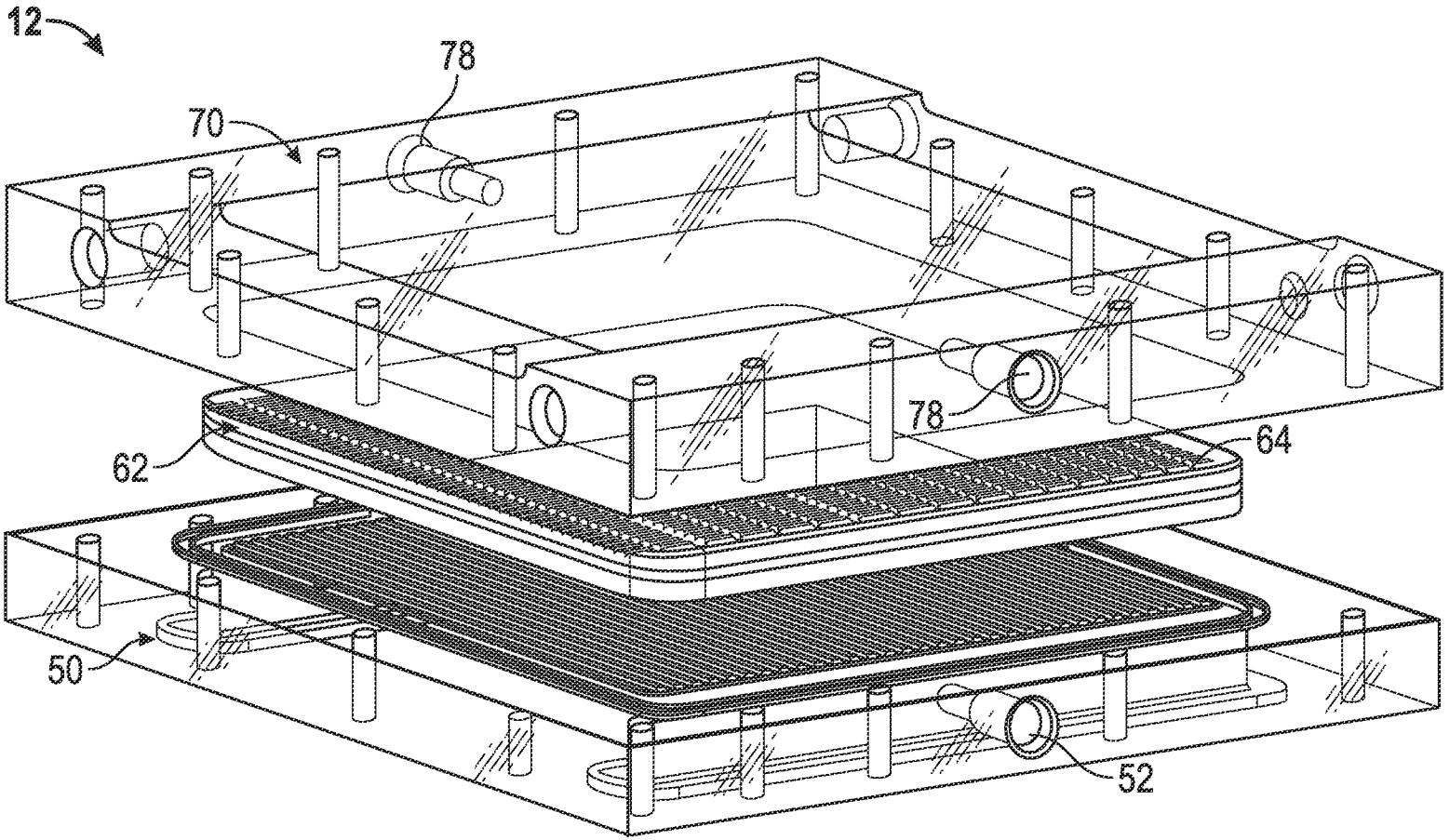
FIG. 2 is a perspective view of an evaporator of the pumped two phase fluid routing system.
Figure 3:
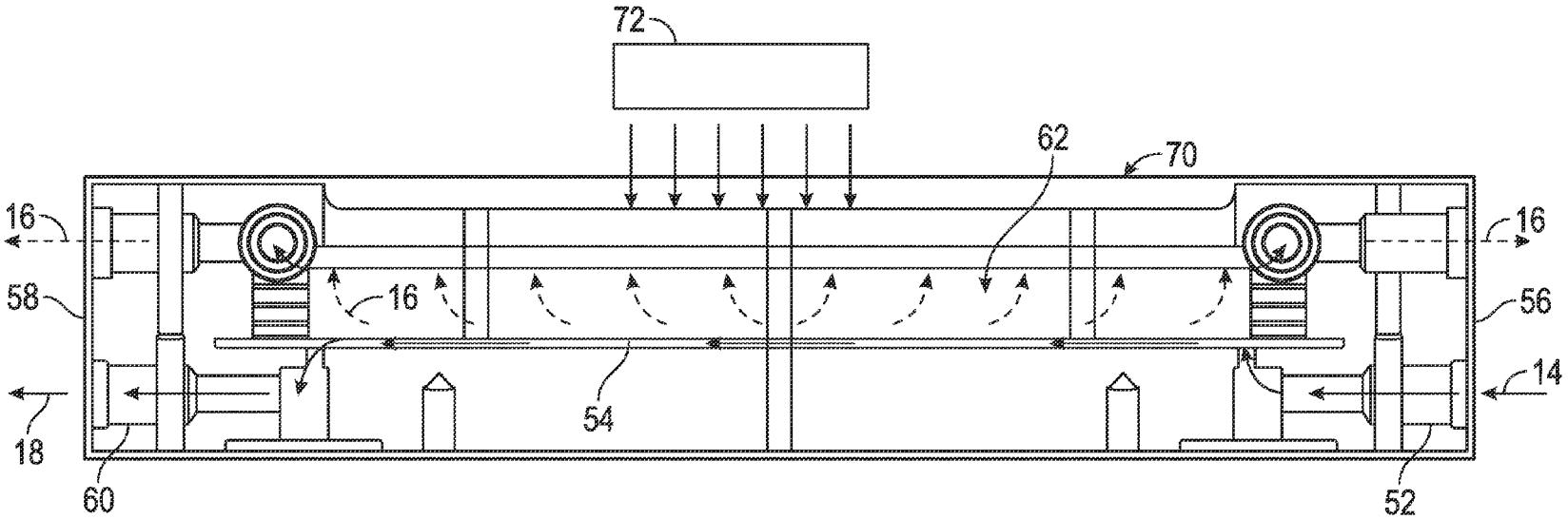
FIG. 3 is a side elevation view of the evaporator.

Referring to FIGS. 2 and 3, the evaporator 12 is illustrated in greater detail. The evaporator 12 includes a base portion 50 having an input liquid port 52 in operable communication with the main feed line 20. The input liquid port 52 receives the working fluid 14 for routing through at least one passage 54 extending through the base portion 50. The at least one passage 54 may be formed of numerous geometries and may extend from a first side 56 of the base portion 50 to an output liquid port 60 disposed on a second side 58 of the base portion 50, as illustrated. However, it is to be appreciated that the input liquid port 52 and the output liquid port 60 may be disposed at any location of the base portion 50. In any event, the at least one passage 54 is disposed between the base portion 50 and a wick portion 62. The wick portion 62 is a porous structure comprising a plurality of holes 64 extending through the wick portion 62 from the base portion 50 to a lid portion 70. A portion of the working fluid 14 saturates the wick portion 62. The lid portion 70 is disposed in close proximity with the wick portion 62 and in one embodiment is in contact with at least a portion of the wick portion 62. As a heat input 72 is added to the evaporator 12, a portion of the working fluid 14, such as the portion saturating the wick portion 62, is vaporized into the vapor 16, which is routed toward a vapor port 78. The liquid 18 and the vapor 16 are separated by capillary pressure imposed by the plurality of holes 64 of the wick portion 62, which is saturated. The portion of the working fluid 14 that is not vaporized continues through the at least one passage 54 to the outlet liquid port 60 for routing to the first liquid line 24.

It is to be appreciated that the base portion 50, the wick portion 62 and the lid portion 70 are substantially planar members that are disposed relatively parallel to each other. Such an arrangement provides the ability to scale the evaporator 12 to varying sizes to accommodate spatial constraints and variation of heat source applications.

Figure 4:
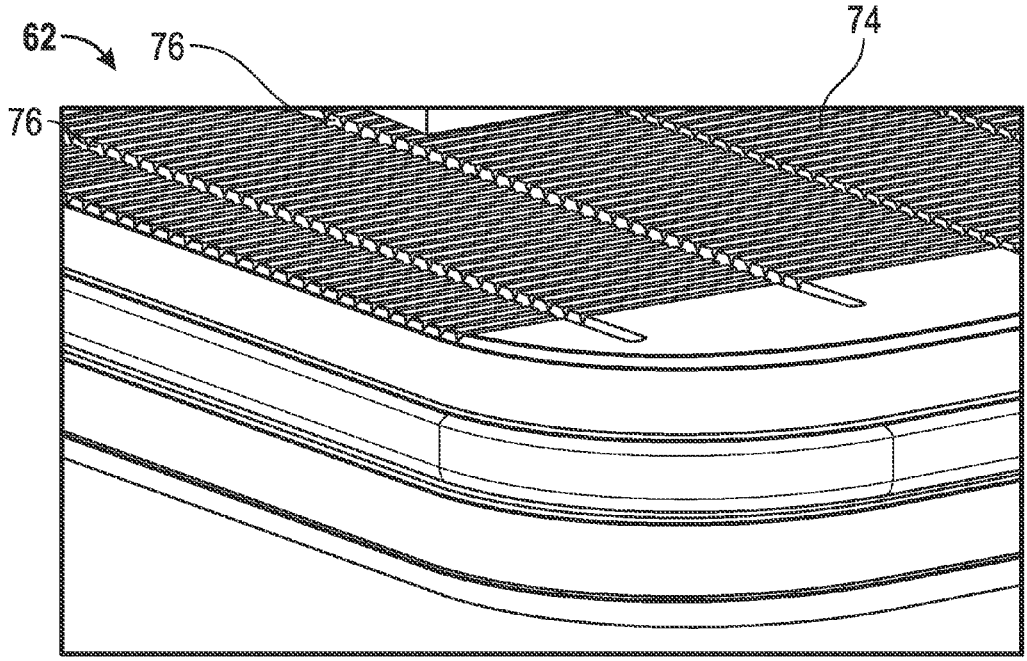
FIG. 4 is a perspective view of a wick portion of the evaporator.
Figure 5:
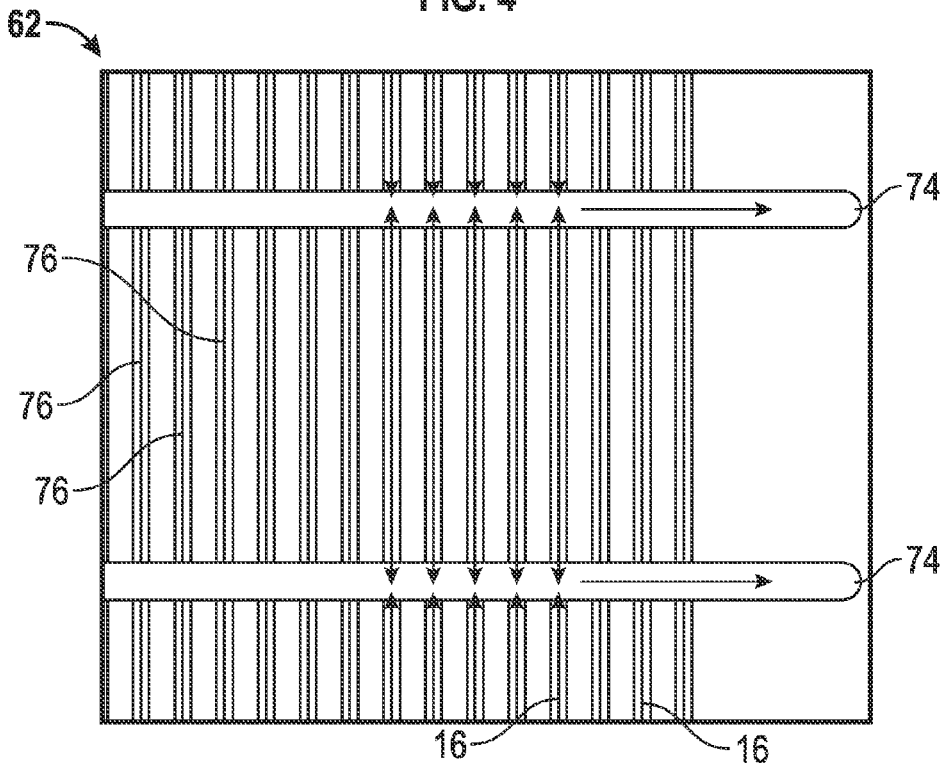
FIG. 5 is a top plan view of the wick portion of the evaporator.

Referring now to FIGS. 4 and 5, the wick portion 62 is illustrated in greater detail. The wick portion 62 includes at least one, but typically a plurality of vapor grooves 74 extending in a first direction toward at least one, but typically a plurality of vapor vents 76. The plurality of vapor grooves 74 and the plurality of vapor vents 76 combine to form a routing network for the vapor 16 to flow through toward the vapor port 78 for expulsion to the vapor line 22. The plurality of vapor grooves 74 and the plurality of vapor vents 76 are in close proximity with the lid portion 70 and are sandwiched between the wick portion 62 and the lid portion 70.

Figure 6:
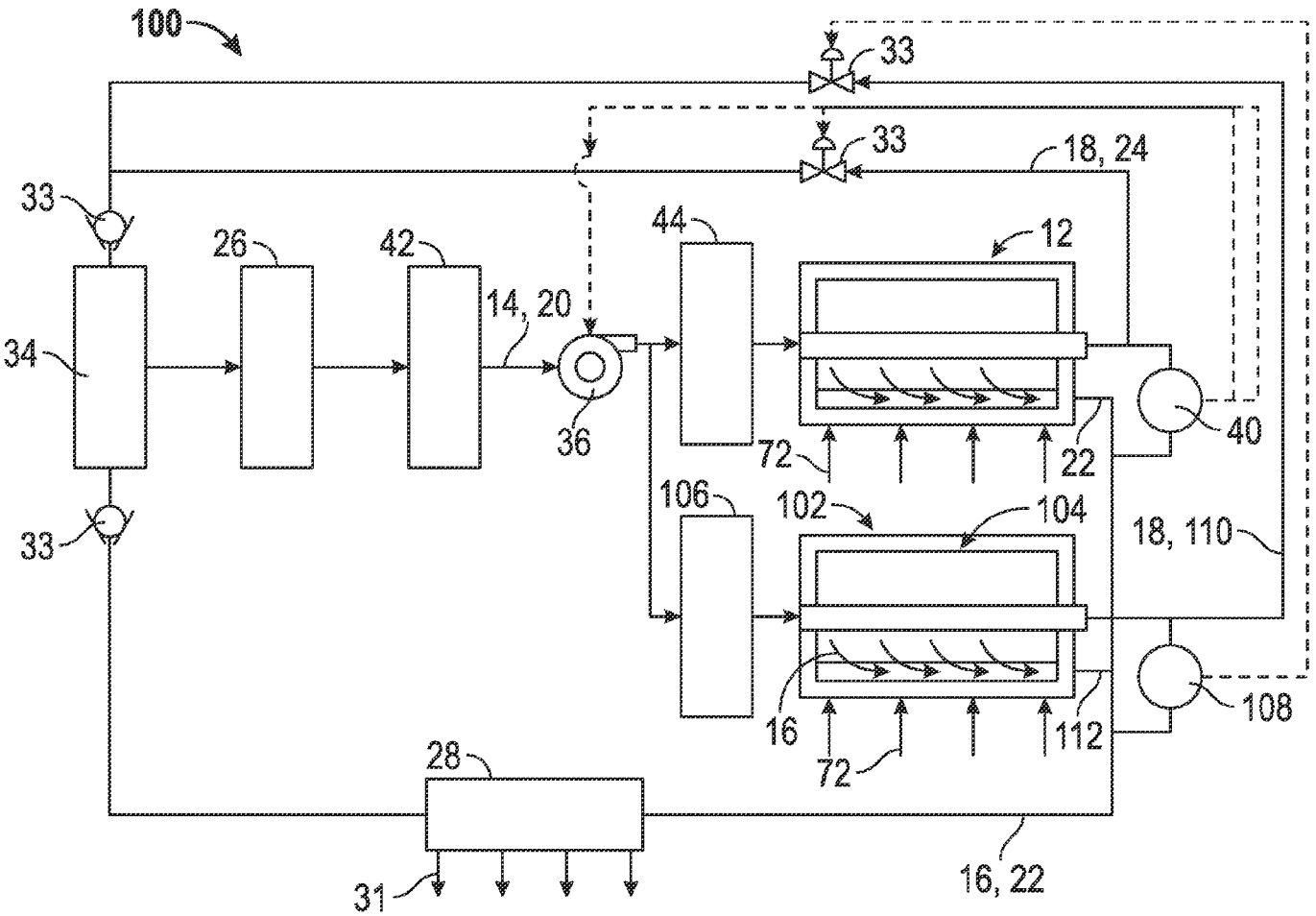
FIG. 6 is a schematic illustration of the pumped two phase fluid routing system according to a second embodiment.

Referring to FIG. 6, a fluid routing system 100 according to a second embodiment is schematically illustrated. The fluid routing system 100 is similar in several respects to the first embodiment described above with respect to FIG. 1, such that similar reference numerals are employed where applicable. Additionally, features described in detail above are not described redundantly with respect to the second embodiment. The fluid routing system 100 includes at least one secondary circuit 102 that branches off of the main feed line 20 of the fluid routing system 10. The at least one secondary circuit 102 includes an additional evaporator 104 similar in construction and function as that of the evaporator 12 described above. Additionally, the at least one secondary circuit 102 includes a third cooling device 106 disposed downstream of the pump 36 for cooling of the working fluid 14 prior to entry to the additional evaporator 104. As is the case with the fluid routing system 10, an additional controller 108 is in operable communication with several components, such as the additional evaporator 104, a third liquid line 110 and a second vapor line 112, as well as the components described above that the controller 40 is in communication with. In one embodiment, the vapor line 22 and the second vapor line 112 are merged for routing to the condenser 28. In an alternate embodiment, the second vapor line 112 can be routed to a separate condenser (not illustrated), and back to the phase separator 34. Similarly, the first liquid line 24 and the third liquid line 110 are merged for routing to the phase separator 34 and the reservoir 26. As illustrated, the at least one secondary circuit 102 is disposed in parallel with the evaporator 12 of the fluid routing system 10. As the name suggests, additional circuits containing additional evaporators may be implemented in the relatively parallel configuration illustrated and described above.

Figure 7:
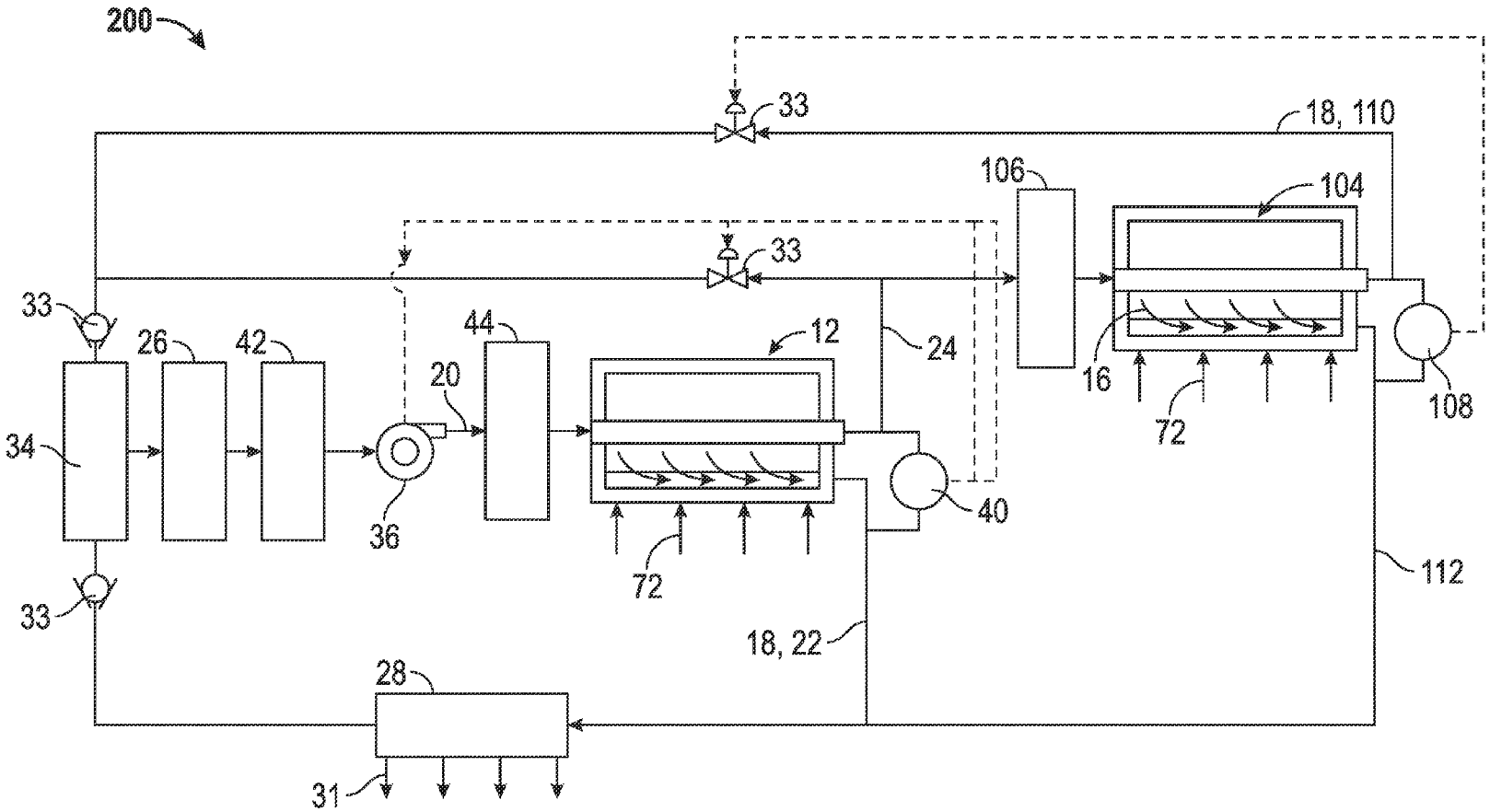
FIG. 7 is a schematic illustration of the pumped two phase fluid routing system according to a third embodiment.

Referring to FIG. 7, a fluid routing system 200 according to a third embodiment is schematically illustrated. The third embodiment is similar in many respects to the embodiments described above, such that duplicative description is omitted and similar reference numerals are employed where applicable. The third embodiment includes an additional circuit, as is the case with the second embodiment, but rather than a parallel arrangement, the additional circuit(s) is disposed in series with the evaporator 12 of the fluid routing system 10.

Figure 8:
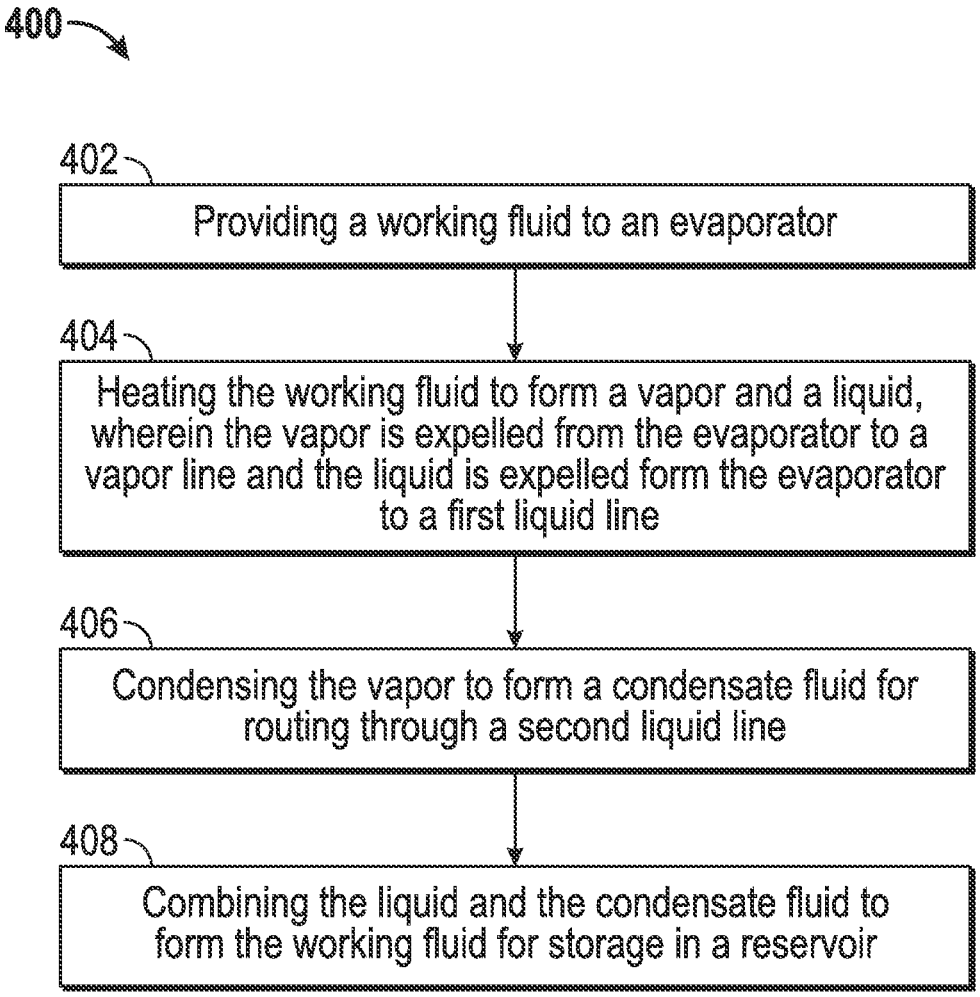
FIG. 8 is a flow diagram illustrating a method of routing a working fluid for transferring heat.

A method of routing a working fluid for transferring heat 400 is also provided as illustrated in FIG. 8 and with reference to FIGS. 1-7. The fluid routing system 10 and the evaporator 12 have been previously described and specific structural components need not be described in further detail. The method of routing a working fluid for transferring heat 400 includes providing a working fluid to an evaporator 402. The working fluid is heated to form a vapor, where the vapor is expelled from the evaporator to a vapor line and the excess liquid is expelled from the evaporator to a first liquid line 404. The vapor is condensed to form a condensate fluid to form the working fluid for storage in a reservoir 406. The liquid is combined with the condensate fluid to form the working fluid for storage in a reservoir 408.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A pumped two phase fluid routing system comprising:

an evaporator comprising:

a base portion having an input liquid port for receiving a working fluid and an output liquid port for expelling a liquid;

a wick portion including a plurality of vapor grooves and a plurality of vapor vents for providing a vapor flow path of a vapor formed within the evaporator; and a lid portion disposed in close proximity to the wick portion and receiving heat for formation of the vapor, the lid portion having a vapor port for expelling the vapor;

a first liquid line in fluid communication with the base portion for receiving the expelled liquid; and a vapor line in fluid communication with the lid portion for receiving the expelled vapor;

a first cooling device in operable communication with a main feed line, the cooling device configured to cool the working fluid prior to entry to the evaporator;

a pump for routing the working fluid along the main feed line into the evaporator; and a second cooling device, wherein the first cooling device is disposed upstream of the pump and the second cooling device is disposed downstream of the pump at a location just prior to delivery of the working fluid to the evaporator.

2. The pumped two phase fluid routing system of claim 1, wherein the base portion, the wick portion and the lid portion are substantially planar members disposed parallel to each other.

3. The pumped two phase fluid routing system of claim 1, further comprising:

a condenser disposed along the vapor line, the condenser receiving the vapor for condensing the vapor to a condensate fluid for routing through a second liquid line; and a reservoir in operable communication with the first liquid line and the second liquid line, the reservoir receiving the liquid and the condensate fluid as the working fluid for storage therein.

4. The pumped two phase fluid routing system of claim 3, further comprising a phase separator disposed upstream of the reservoir for receiving the liquid and the condensate fluid to form the working fluid distributed to the reservoir.

5. The pumped two phase fluid routing system of claim 3, further comprising a controller in operable communication with the evaporator and a motor, the motor configured to drive the pump.

6. The pumped two phase fluid routing system of claim 3, further comprising at least one secondary circuit comprising a plurality of evaporators disposed in parallel.

7. The pumped two phase fluid routing system of claim 3, further comprising at least one secondary circuit comprising a plurality of evaporators disposed in series.

8. A method of routing a working fluid for transferring heat comprising:

providing a working fluid to an evaporator;

cooling the working fluid in a first cooling device prior to delivery of the working fluid to the evaporator;

pumping the working fluid along a main feed line with a pump located downstream of the first cooling device;

cooling the working fluid in a second cooling device that is located downstream of the pump and just prior to delivery of the working fluid to the evaporator;

heating the working fluid to form a vapor and a liquid, wherein the vapor is expelled from the evaporator to a vapor line and the liquid is expelled from the evaporator to a first liquid line;

condensing the vapor to form a condensate fluid for routing through a second liquid line; and combining the liquid and the condensate fluid to form the working fluid for storage in a reservoir.

9. The method of claim 8, wherein heating the working fluid comprises heating a lid portion of the evaporator that is disposed in close proximity to a wick portion, the lid portion and the wick portion being substantially planar and arranged relatively parallel to each other.

10. The method of claim 8, wherein combining the liquid and the condensate fluid to form the working fluid comprises routing the liquid and the condensate fluid into a phase separator.

11. The method of claim 10, further comprising expelling the working fluid from the phase separator along the main feed line.

12. The method of claim 8, further comprising controlling a motor configured to drive the pump with a controller in operable communication with the evaporator.

13. The method of claim 8, further comprising providing the working fluid to a plurality of evaporators.

* * * * *